US006699338B2

(12) United States Patent
Kimura et al.

(10) Patent No.: US 6,699,338 B2
(45) Date of Patent: Mar. 2, 2004

(54) METHOD OF MANUFACTURING CORROSION RESISTANT STEEL MATERIALS

(75) Inventors: Tatsumi Kimura, Okayama (JP); Kazuhiko Shiotani, Okayama (JP); Fumimaru Kawabata, Okayama (JP); Keniti Amano, Okayama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/236,907

(22) Filed: Sep. 9, 2002

(65) Prior Publication Data

US 2003/0062101 A1 Apr. 3, 2003

Related U.S. Application Data

(63) Continuation of application No. 09/719,007, filed as application No. PCT/JP00/02274 on Apr. 7, 2000, now abandoned.

(30) Foreign Application Priority Data

Apr. 8, 1999 (JP) ..... 11-101743
Apr. 15, 1999 (JP) ..... 11-107639

(51) Int. Cl.[7] ..... C21D 8/02
(52) U.S. Cl. ..... 148/541; 148/546
(58) Field of Search ..... 148/330, 320, 148/541, 546

(56) References Cited

U.S. PATENT DOCUMENTS 4,094,670 A 6/1978 Bruno et al.
6,238,493 B1 5/2001 Lin et al.
6,315,946 B1 * 11/2001 Focht ..... 148/332
6,436,340 B1 * 8/2002 Siotani et al. ..... 148/332

FOREIGN PATENT DOCUMENTS

| | | |
|---|---|---|
| EP | 0 528 407 A1 | 2/1993 |
| JP | 52-150324 | 12/1977 |
| JP | 60052522 | 3/1985 |
| JP | 62-256947 | 11/1987 |
| JP | 3-158436 | 7/1991 |
| JP | 5-9570 | 1/1993 |
| JP | 05171265 | 7/1993 |
| JP | 8-143954 | 6/1996 |
| JP | 08225888 | 9/1996 |
| JP | 9-137218 | 5/1997 |
| JP | 09316617 | 12/1997 |
| JP | 10-046285 | 2/1998 |
| JP | 10-204575 | 8/1998 |
| JP | 11-080880 | 3/1999 |
| JP | 11-092857 | 4/1999 |

* cited by examiner

*Primary Examiner*—Deborah Yee
(74) *Attorney, Agent, or Firm*—Young & Thompson

(57) ABSTRACT

A steel material excellent in weathering resistance by defining the chemical ingredients in the steel each to a predetermined range and setting an ingredient parameter formula in accordance with the working circumstance thereby reducing the flow rust and, particularly, forming stable rust with good protective property even in a salty circumstance such as in coast districts is provided. Further, also considering the amount of A type inclusions and B type inclusions according to JIS G 0555, a steel material of excellent earthquake proofness and weathering proofness also including weld heat affect zone is provided.

9 Claims, 5 Drawing Sheets

METHOD OF MANUFACTURING CORROSION RESISTANT STEEL MATERIALS

Figure 1:
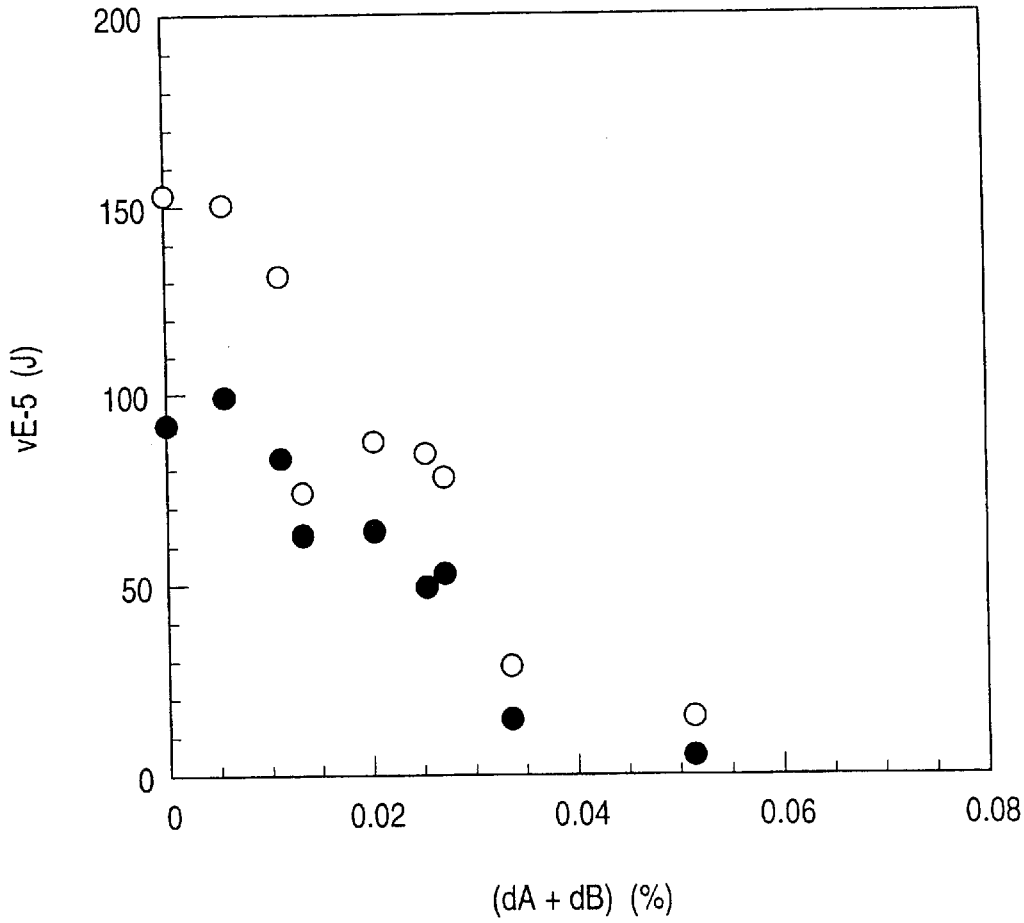

This application is a continuation of application Ser. No. 09/719,007, filed of Dec. 7, 2000 now abandoned. Application Ser. No. 09/719,007 is the national phase of PCT International Application No. PCT/JP00/02274 filed Apr. 7, 2000 under 35 U.S.C. §371. The entire contents of each of the above-identified applications are hereby incorporated by reference.

TECHNICAL FIELD

This invention concerns weathering resistant steel materials and, it relates to a flow rust reducing weathering resistant steel materials capable of effectively reducing occurrence of flow rust in relatively less salty circumstances such as mountain districts, rural districts and industrial districts, as well as steel materials excellent in earthquake proofness and coast weathering resistance applicable as steel structures such as bridges used in salty circumstances such as coast districts. The weathering resistance referred to in the invention means weathering resistance in a case of use in atmospheric air of coast districts.

BACKGROUND ART

1) Less Salty Circumstance

Weathering resistant steels with improved weathering resistance in atmospheric air with addition of alloying elements such as P, Cu, Cr and Ni in the steels have been used generally for structures such as bridges. The weathering resistant steels form, in several years, rust referred to as stable rust less permeating oxygen and water causing corrosion and suppress subsequent corrosion. Accordingly, the weathering resistant steels require no coating of anti-rust paints and they are highly corrosion resistant material which can be used in a so-called naked state.

However, since as long as several years are required till the stable rust is formed during which flow rust occurs in the weathering resistant steels, they involve problems of deteriorating scenes and causing environmental contamination.

In view of the problems described above, Japanese Patent Laid-Open No. 136557/1994, for example, proposes a surface treating method for steel materials of coating an aqueous solution of chromium sulfate or an aqueous solution of copper sulfate and further applying organic resin coating after drying the water content. Further, Japanese Patent Laid-Open No. 13158/1996 proposes a surface treating method of steel materials of coating an aqueous solution containing aluminum ions and further forming an organic resin film after drying of the water content.

However, in the techniques described in Japanese Patent Laid-Open No. 136557/1994 and Japanese Patent Laid-Open No. 13158/1996, while stable rust is grown in a short period of time, they still leave problems such that steps are complicated and the surface treating agents used are expensive, and development of weathering resistant steel materials not requiring surface treatment have been demanded.

In view of the above, for coping with such a demand, the invention intends to provide flow rust reducing weathering resistant steel materials capable of reducing occurrence of flow rust in the course of forming stable rust in weathering resistant steels used in a naked state.

2) Salty Circumstance such as Coast Districts

Steel structures such as bridge girders are generally applied with corrosion preventive means such as coating since their service life is long. However, the coating films are degraded to gradually reduce the corrosion preventive effect by chalking due to UV-rays, or expansion of rust by the corrosion under coating films. Accordingly, re-coating has been obliged on every certain periods. However, shortening of coating operators and increase in the personal expense in recent years makes the re-coating operation difficult. In view of the situations, weathering resistant steels requiring no coating of anti-rust paints and usable in a naked state have been applied more and more in steel structures.

The weathering resistant steels are those steel materials with addition of P, Cu, Ni and Cr in which stable rusts as protective films are formed in several years on the surface of steels in an atmospheric circumstance. Since the stable rust suppresses further development of corrosion, corrosion of the steel materials can be minimized. Accordingly, most of them are used with no coating.

However, in salty circumstances such as coast districts, no stable salt is formed after lapse of several years even in weathering resistant steels and steel materials are attacked violently.

In recent years, application guideline for weathering resistant steels have been issued from Minister of Construction (Joint Research Report Regarding Application of Weather Resistant Steel Material to Bridges (XX), March 1993, published from Civil Engineering Institute of Minister of Construction, KOZAI CLUB Co. and Nippon Kyoryo Kensetsu Kyokai), in which it is specified that existent weathering resistant steels (JIS G 3114: weathering resistant hot rolled steel materials for welding structure) can not be used with no coating in the district where atmospheric salt content is 0.05 $mg/dm^2/day$ or more, that is, in coast districts.

Accordingly, in salty circumstances such as coast districts, countermeasure has been adopted by applying coating such as of phthalic acid resin, chlorinated rubber or tar epoxy resin to ordinary steel materials. However, since bridges constructed in coast districts near the estuaries are often long and large and the corrosion is violent because of the use in the coast districts, the re-coating operation is extremely difficult and, accordingly, there is a strong demand for the steel materials that can be used with no coating.

Regarding this Japanese Patent Laid-Open No. 136557/1994, for example, leaves problems as described above.

Further, Japanese Patent No. 2572447, Japanese Patent Laid-Open NO. 51668/1993 and Japanese Patent Laid-Open No. 134587/1996 propose methods of improving the coast weathering resistance by adding a great amount of alloying elements such as P, Cu, Ni and Mo to steel materials.

However, referring to the bridge, the corrosive circumstance for steel materials are not always identical depending on the places to be used. Considering, for example, four main beam bridge, while outside of the beams are exposed to rainfall, water of condensation and sunshine, inside of the beam are exposed only to water of condensation but not suffer from rainfall. Generally, in a clean circumstance with no atmospheric salt content, it is said that the extent of corrosion is less in the inside of the beams when compared between the inside and the outside of the beams. On the other hand, in the circumstance with high atmospheric salt content, it is said that the extent of corrosion is rather greater in the inside of the beam than the outside of the beam. This reversal phenomenon occurs at a certain content of the atmospheric salt content as a boundary but the content can not be specified.

However, since outer beams, main beams and webs are exposed to two circumstances (with or without exposure to rainfalls) simultaneously (rear face and surface of plates), it is necessary for the steel materials to be used in steel structures such as bridges to maintain high weathering resistance in both of the circumstances.

However, in the existent techniques, evaluation was applied only under one circumstance (with rainfall or without rainfall), and development for steel materials having excellent coast weathering resistance simultaneously under two circumstances has been demanded.

3) Earthquake Proofness

On the other hand, the structural steel materials of this type utilized, for example, in bridge beams, have been (demanded to have an absorbed energy of 47J or more at −5° C. in a Charpy impact test in the rolling direction (L direction) and a cross direction (C direction) to the rolling direction of the steel materials in view of the safety. However, it has been found that high stresses may possibly exert in the direction of the plate thickness of the material to be used (Z direction) depending on the structure and the portions of the structures in large scale earthquakes such as Hanshin-Awaji disaster, so that it has been demanded for the steel materials for use in structures to improve the toughness in the direction of the plate thickness (Z direction) including the weld heat affect zone in order to further increase the earthquake proofness of steel materials after the Hanshin-Awaji disaster.

From the view points (1)–(3) above, the invention intends to provide a steel material capable of forming stable rust with good protective performance in relatively less salty districts and salty circumstance such as coast districts, regardless of rainfalls, excellent in weather proofness and excellent in earthquake proofness with improved toughness in the direction of Z also including the weld heat affective zone.

DISCLOSURE OF THE INVENTION

1) Flow Rust Reducing Weathering Resistant Steel Material

The present inventors have made an earnest study for the thickness capable of reducing flow rust in weathering resistant steels and, as a result, have found that a weathering resistant steel material capable of outstandingly reducing the amount of flow rust by adding B and, further, by controlling the content of B and the content of one or more of P, Cu, Ni, Cr and Mo based on a certain relationship to each other.

The invention has been achieved on the basis of this finding and the feature resides in a flow rust reducing weathering resistant steel material having a composition containing, on the weight % basis, C: from 0.001% to 0.050%, Si: 0.60% or less, Mn: from 0.50% to 3.00%, S: 0.01% or less, Al: 0.10% or less and B: from 0.0003% to 0.0050% and, further, one or more of elements selected from P: from 0.005% to 0.15%, Cu; from 0.1% to 2.0%, Ni: from 0.1% to 6.0%, Cr: from 0.005% to 1.0% and Mo: from 0.005% to 1.0%, and satisfying the following equation (1):

$$(20P+3Cu+3Ni+6Cr+Mo)/(1-0.2(10000B)^{0.4})\geqq 18 \quad (1)$$

in which P, Cu, Ni, Cr, Mo, B: content for each element (wt %)), and the balance of Fe and inevitable impurities.

Further, in this invention, one or more of elements selected from Nb: from 0.005% to 0.20%, Ti: from 0.005% to 0.20%, V: from 0.005% to 0.20%, on the weight % basis, may be contained in addition to the composition described above.

Further, in the invention, one or more of elements selected from Ca: 0.02% or less and REM: 0.02% or less may be contained, on the weight % basis, in addition to the composition described above.

2) Coast Weathering Resistant Steel Material

The present inventors have made an earnest study for improving the coast weathering resistance and, as a result, have obtained a knowledge that Cr degrade the weathering resistance in circumstance containing much salt. Further, the present inventors have found that steel materials of excellent weathering resistance even in salty circumstances such as coast districts can be obtained by controlling the content of B and the content of one or more of P, Cu, Ni and Mo in relation the atmospheric salt content.

3) Compatibility with Earthquake Proofness

Further, the inventors have found that the sum of inclusions, particularly, the amount of A series and B series inclusions gives a significant effect on the toughness in the Z direction and the toughness in the Z direction can be improved remarkably by restricting the sum (dA+dB) value for the A series inclusion amount and the B series inclusion amount according to JIS G 0555 to 0.030% or less.

At first, the result of experiment conductive by the present inventors regarding the relation between the toughness in the Z direction and the amount of inclusions is to be explained.

Steels were prepared by melting while variously changing the forms and the amount of inclusions into steel plates of 60 mm thickness by hot rolling. Test pieces for microscopic observation and test pieces for Charpy impact shock in the Z direction (JIS No. 4 test specimen) were sampled from the steel plates, and the form and the amount of inclusions and the toughness in the Z direction (absorbed energy) were measured.

FIG. 1 shows a relation between the sum (dA+dB) value of the A type inclusions and the amount of B type inclusions according to JIS G 0555 and the Charpy absorbed energy ($_vE_{-5}$) in the Z direction at −5° C. In the Charpy impact test, ten specimens were used for each of the steel plates. Mean values and the minimum values for ten specimens are plotted respectively in the drawing.

As shown in FIG. 1, when the (dA+dB) value is 0.030% or less, absorbed energy of 47J or more at −5° C. and high toughness in the Z direction are shown including minimum values. On the other hand when the (dA+dB) value exceeds 0.30%, low values appear for the minimum value and also the mean value decreases below 47J.

Figure 2:
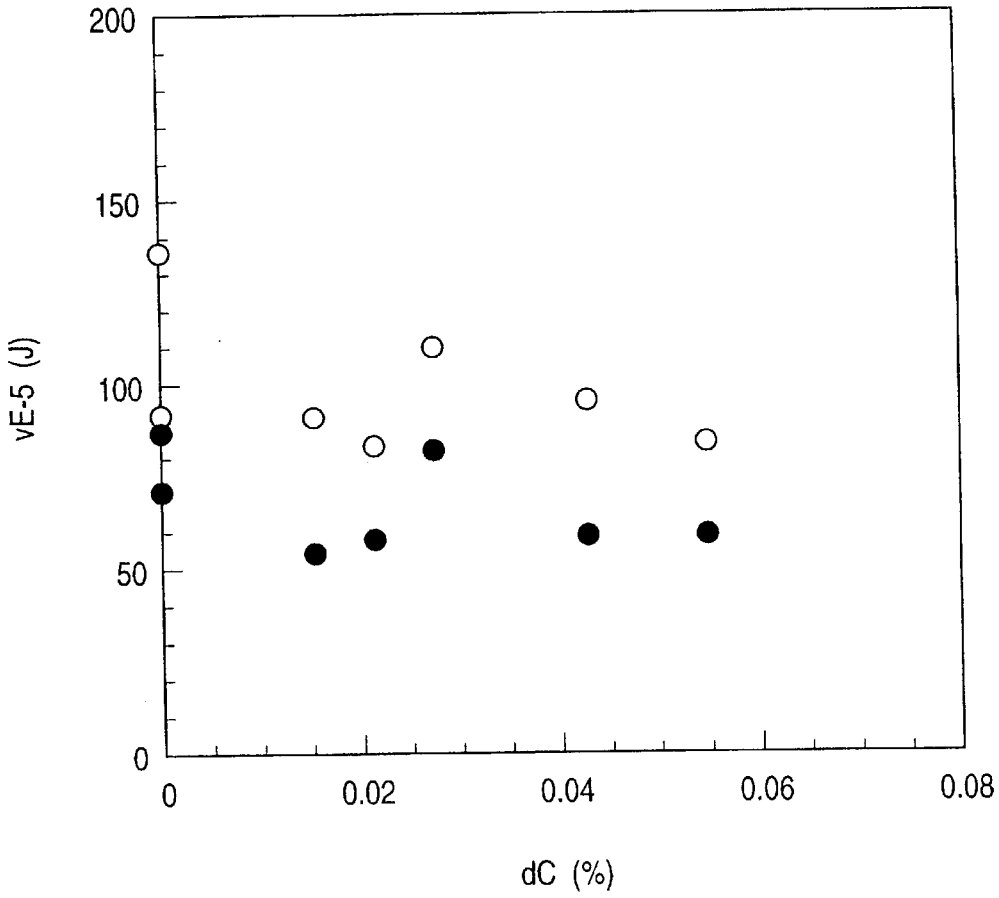

FIG. 2 shows a relation between the dC value for the amount of C type inclusions according to JIS G 0555 and the Charpy absorbed energy in the Z direction at −5° C. ($_vE_{-5}$). In FIG. 2, the relation between the dC value and $_vE_{-5}$ is shown for the steel plates having the (dA+dE) value within range from 0.021% to 0.028%, which show high toughness in the Z direction.

It was not recognized from FIG. 2 that the dC value for the amount of C type inclusions give particular effect on the toughness in the Z direction.

In view of the above, the inventors have obtained the knowledge that control of the sum (dA+dB) value for the A type inclusions and the B type inclusions is important for improving the toughness in the direction of the plate thickness. Particularly, it has been found that the toughness in the direction of the plate thickness is improved remarkably by defining the (dA+dB) value to 0.030% or less.

Figure 3:
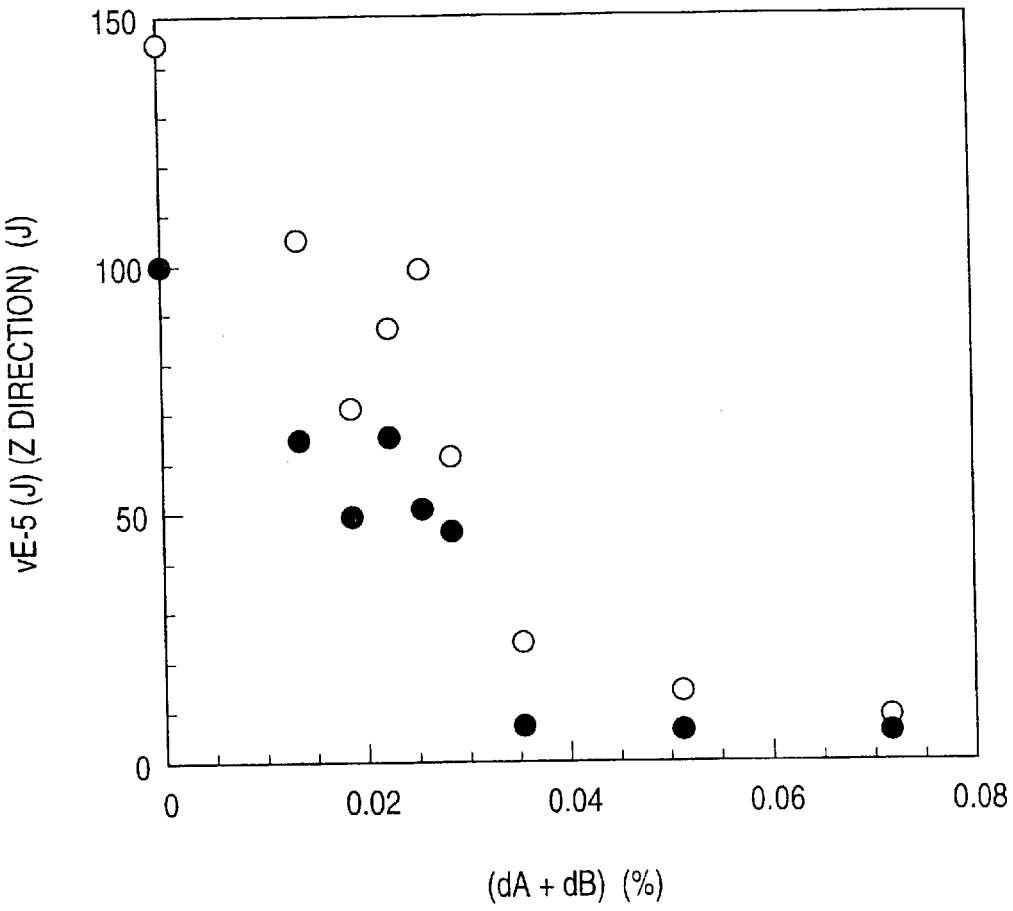
Figure 4:
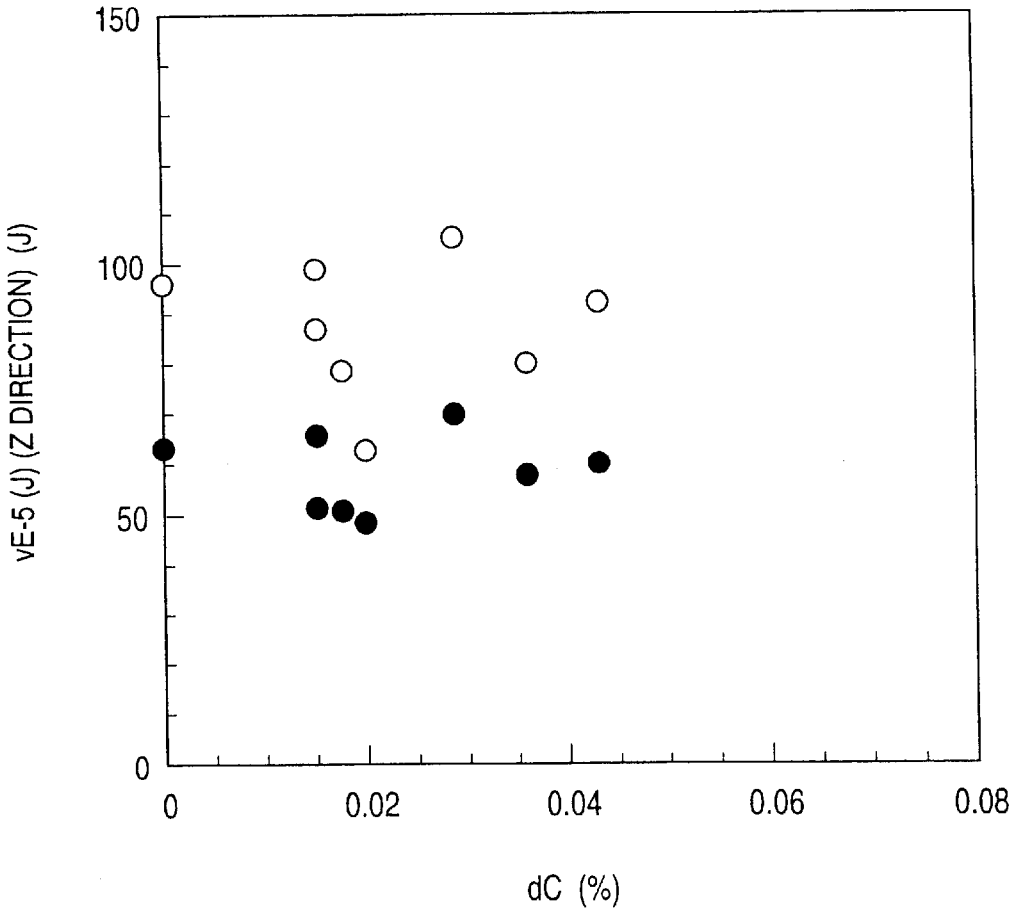

FIG. 1 and FIG. 2 show the knowledge obtained from the coast weathering resistant steel materials and similar results have also been obtained for the flow rust reducing weathering resistant steel materials (FIG. 3 and FIG. 4).

This invention has been accomplished based on the findings described above.

BRIEF EXPLANATION FOR THE DRAWINGS

FIG. 1 is a graph showing a relation between the toughness in the Z direction and the sum for the amounts of A type inclusions and B type inclusions in coast weathering resistant steel materials.

dC=0%–0.020%

○: mean value, ●: minimum value

FIG. 2 is a graph showing a relation between the toughness in the Z direction and the amount of C type inclusions in coast weathering resistant steel materials.

dA+dB=0.020%–0.028%

○: mean value, ●: minimum value

FIG. 3 is graph showing a relation between the toughness in the Z direction and the sum for the amounts of A type inclusions and B type inclusions weathering resistant steel materials for less salty circumstance.

dC≦0.020%

○: mean value, ●: minimum value

FIG. 4 is a graph showing a relation between the toughness in the Z direction and the amount of C type inclusions in weathering resistant steel materials for less salty circumstance.

dA+dB=0.020%–0.028%

○: mean value, ●: minimum value

Figure 5:
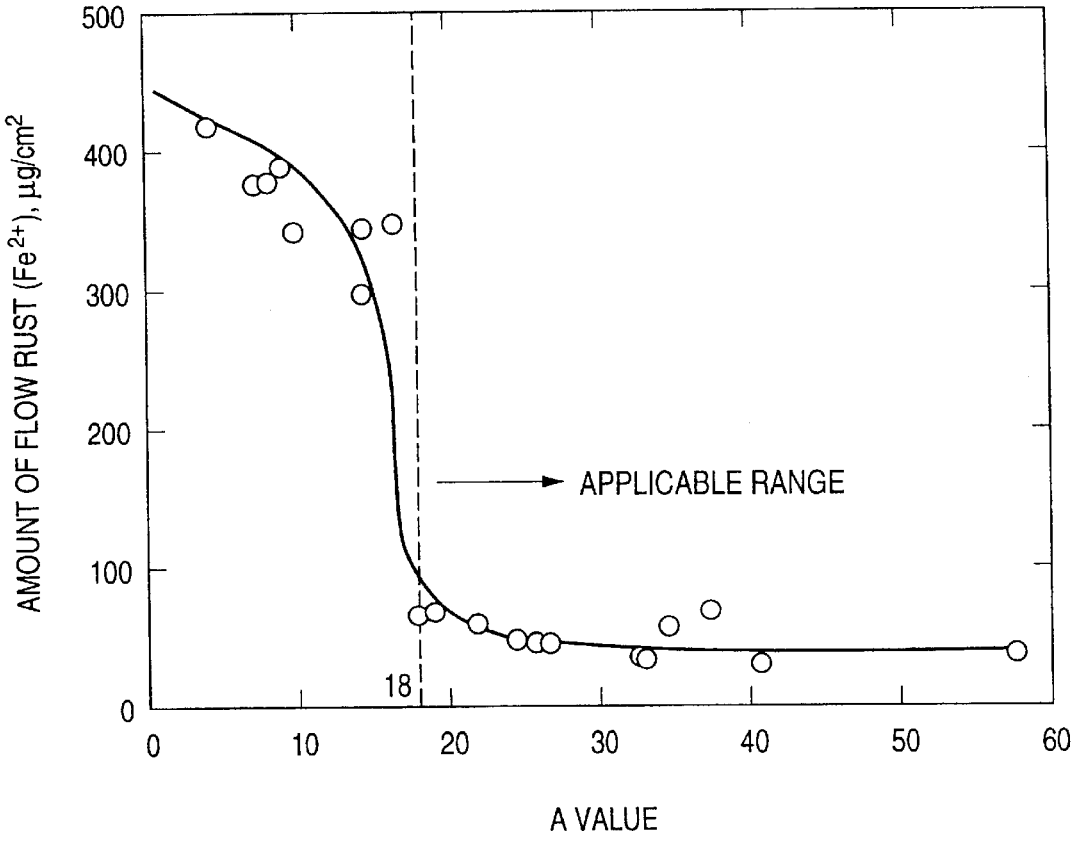

FIG. 5 is a graph showing a relation between the amount of flow rust and the A value (value in the left side of the formula (1)) weathering resistant steel materials for less salty circumstance.

BEST MODE FOR PRACTICING THE INVENTION

At first, reasons for defining the ingredients in the steel materials according to the invention are to be explained.

1) C: from 0.001% to 0.050%

C is an element for increasing the strength and a content of 0.001% or more is necessary in order to obtain a desired strength but the toughness is degraded when it is contained by a great amount of exceeding 0.050%, so that it is defined as from 0.001% to 0.050% in the invention.

Preferably, it is from 0.005% to 0.030%. Further preferably, it is from 0.005% to 0.025%.

2) Si: 0.60% or Less

Si is an element acting as a deoxidizer and increasing the strength of the steel but, since the toughness and the weldability are degraded if it is contained by a greater amount, it is defined to 0.60% or less. Preferably, it is from 0.15% to 0.50%.

3) Mn: from 0.50% to 3.00%

Mn is an element greatly contributing to the increase of the strength and the toughness of the steel and it is necessary to be contained by 0.50% or more in order to ensure the desired strength in the invention. However, when it is contained by a greater amount exceeding 3.00%, it gives an undesired effect on the toughness and the weldability, so that it is defined within a range from 0.50% to 3.00%. Preferably, it is 0.50% to 1.80%.

4) S: 0.01% or Less

Since S degrades the weathering resistance and further degrades the weldability and the toughness, it is defined to 0.01% or less.

Particularly, since it increases the amount of A type inclusions and, particularly, lowers the toughness in the direction of the plate thickness and degrades the weathering resistance, it is defined as 0.005% or less and, it is preferably 0.003% or less with a view point of the toughness.

5) Al: 0.10% or Less

Al acts as a deoxidizer but since it gives an undesired effect on the weldability when contained in excess of 0.10%, the upper limit is defined to 0.10%.

Further, Al is added as a deoxidizer but, when it is contained in excess of 0.10%, the B type inclusions increase to lower the toughness in the direction of the plate thickness due to the formation of alumina clusters. Accordingly, Al is defined to 0.10% or less and it is preferably, 0.05% or less with a view point of the toughness.

6) B: from 0.0003% to 0.0050%

B is an element for improving the hardenability and also improving the weathering resistance and is an important element in the invention. Such an effect is recognized by the content of 0.0003% or more but no corresponding effect to the content can be expected even if it is contained in excess of 0.0050%. Accordingly, B is defined within a range from 0.0003% to 0.0050%. Preferably, it is within a range from 0.0003% to 0.0030%.

While the details for the mechanism in which B improves the weathering resistance are not apparent, they are generally considered as below.

Generally, for reducing flow rust, it is necessary to form rust from the matrix in an early stage and, further make the rust dense. The purpose of densification is to improve the corrosion preventive effect by the rust layer and to improve the adhesion of the rust layer to the matrix. Adhesion of rust grains to the matrix is considered to be attributable to the anchoring effect. Accordingly, as the rust grains are more dense, the anchoring effect is greater. By the way, the rust grains formed from iron by anodic dissolution due to rainfall and water of condensation are grown with water and densified as pH value increases. In view of the above, it is considered that B increases pH in the water immersed rust layer to promote the densification of the rust grains.

7) P: from 0.005% to 0.15%

P is an element for promoting the anodic dissolution of the matrix in the early stage of corrosion and making the rust grains more dense and it is preferably incorporated positively in this invention. Such an effect is not recognized when the P content is less than 0.005%. However, when it exceeds 0.15%, the effect of improving the weathering resistance is saturated and, further, the weldability is degraded. Accordingly, it is preferred to define P within a range from 0.005% to 0.15%. Preferably it is from 0.010% to 0.120%.

8) Cu: from 0.1% to 2.0%

Cu has an effect like P. That is, this is an element for promoting the anodic dissolution of the matrix in the early stage of corrosion and making the rust grains more dense. However, the effect is insignificant if the Cu content is less than 0.1% and, on the other hand, if it exceeds 2.0%, it hinders hot workability, the effect of improving the weathering resistance is saturated to result in economical disadvantage. Therefore, the content of Cu is preferably within a range from 0.1% to 2.0%. It is preferably within a range from 0.1% to 1.5%.

9) Ni: from 0.1% to 6.0%

Ni densifies the rust grains to improve the weathering resistance but the effect is insignificant if it is less than 0.1%. On the other hand, even if it is incorporated in excess of 6.0%, the effect is saturated and the effect corresponding to the content can not be recognized to result in economical disadvantage. Therefore, Ni is preferably within a range from 0.1% to 6.0%. With a view point of the weathering resistance, a range from 0.1% to 3.5% is desirable.

10) Cr: from 0.005% to 1.0%

Cr is an element for improving the weathering resistance as far as less salty circumstance is concerned. The effect is insufficient at the content of less than 0.005%. On the other hand, even if it is contained in excess of 1.0%, the effect of improving the weathering resistance is saturated to result in economical disadvantage. Therefore, the Cr content is suitably within a range from 0.005% to 1.0%.

As described in the disclosure of the invention, since Cr degrades the weathering resistance in a salty circumstance it is not positively added.

11) Mo: from 0.005% to 1.0%

Mo improves the weathering resistance and, further, increases the strength but the effect is insufficient at the content less than 0.005%. On the other hand, even when it is contained in excess of 1.0%, the effect is saturated and no corresponding effect to the content is recognized, to result in economical disadvantage. Accordingly, Mo is preferably within a range from 0.005% to 1.0%. With a view point of the toughness, it is preferably within a range from 0.005% to 0.5%.

12) Ingredient Defining Formula (1)

[1] Relatively Less Salty Circumstance

In the invention, the foregoing effects can be provided by selecting one or more of five elements of P, Cu, Ni, Cr and Mo and incorporating them respectively within the ranges described above. However, the content for each of the five elements has to be controlled in relation with B so as to satisfy the following equation (1):

$$(20P+3Cu+3Ni+6Cr+Mo)/(1-0.2(10000B)^{0.4})\geqq 18 \quad (1)$$

(where P, Cu, Ni, Cr, Mo, B: content for each element (wt %)). This can outstandingly reduce the amount of flow rust formed.

For example, FIG. 5 is a graph for the result obtained by an atmospheric exposure test for weathering resistant steel plates having various compositions for one year in rural districts, taking the value in the leftside of the equation (1) (referred to as A value) on the abscissa and the amount of flow rust ($Fe^{2+}$) from the test specimens on the ordinate. As can be seen from the graph, the amount of flow rust is drastically reduced by defining the A value to 18 or more.

[2] Salty Circumstance such as Coast District

In the invention, the B content and the content of one or more of P, Cu, Ni and Mo are controlled, in relation with the atmospheric salt content, so as to satisfy the following equation (1).

$$(11P+4.0Cu+3.1Ni+2.6Mo)/(1-0.1(10000B)^{0.35})\geqq 1+13X \quad (1)$$

(where P, Cu, Ni, Cr, Mo, B: content for each element (wt %), X: atmospheric salt content ($mg/dm^2/day$)).

The weathering resistance in coast districts with high atmospheric salt content is improved remarkably by controlling the content for B and the content for one or more of P, Cu, Ni and Mo so as to satisfy the equation (1). Further, steel materials coping with corrosive circumstance (atmospheric salt content X) are obtained by controlling the content for B. P, Cu, Ni and Mo in accordance with the atmospheric salt content X, which can prevent incorporation of unnecessary alloying elements to provide economical advantage.

In a case where the left side in the equation (1):

$$A(11P+4.0Cu+3.1Ni+2.6Mo)/(1-0.1(10000B)^{035})$$

is smaller than the right side in the equation (1):

$$B=1+13X,$$

that is, A<B, the corrosion resistant degrading effect by the atmospheric salt content is greater than the corrosion resistance improving effect by the alloying elements. In order to improve the weathering resistance by overcoming the corrosion resistance degrading effect by the atmospheric salt content, it is necessary to control the content for B, P, Cu, Ni and Mo so as to satisfy A>B. In this invention, when there is an element not added among the alloying elements in the equation (1), it is assumed that the quotient of the elements is calculated as 0. X is defined as an atmospheric salt content measured according to JIS Z 2381 gauge method.

13) One or More of Elements Selected from Nb: from 0.005% to 0.20%, Ti: from 0.005% to 0.20% and V: from 0.005% to 0.20%.

Nb, V and Ti are elements increasing the strength of steel and one or more of them can be added as required. For any of Nb, V and Ti, the effect is recognized by the incorporation of 0.005% or more but the effect is saturated even when it is contained in excess of 0.20% respectively. Accordingly, it is desirable that each of Nb, V and Ti is from 0.005% to 0.20%.

14) One or More Selected from Ca: 0.02% or Less, REM 0.02% or Less.

REM and Ca have an effect of improving the weldability and can be added as required. The effect is recognized by the addition of 0.0005% or more for any of REM and Ca but the upper limit is defined as 0.02% since addition of a greater amount degrades the cleanliness of the steel material.

15) Other Balance Fe and Inevitable Impurities

[1] Relatively Less Salty Circumstance

In addition, the steel material according to this invention comprises the balance Fe and inevitable impurities. As the inevitable impurities, N: 0.010% or less and 0:0.010% or less are allowable.

[2] Salty Circumstance such as Coast Districts

In the same manner, as the inevitable impurities, Cr: 0.1% or less, N: 0.010% or less and O: 0.010% or less are allowable. Cr is added to weathering resistant steels marketed at present as an element for improving the corrosion resistance. However, this is a case in a less salty circumstances and in those districts with high atmospheric salt content, particularly, in coast districts, the element rather deteriorates the weathering resistance and, accordingly, this is not positively added in this invention but it is allowable up to 0.1% as inevitable impurities.

16) (dA+dB) Value: 0.030% or Less

In the invention, in addition to the definition for the chemical ingredients described above, the sum (dA+dB) value for the amount of A type inclusions and the amount of B type inclusion according to JIS G 0555 is defined as 0.030% or less considering the earthquake proofness and with a view point of ensuring the toughness in the Z direction (absorbed energy in a Charpy impact test) of 47J or more at −5° C.

In this case, the A type impurities are plastically deformed by processing and B type impurities comprise granular inclusions arranged discontinuously grouped in the processing direction. In addition, C type impurities (inclusions dispersing irregularly with no plastic deformation) can be mentioned as one of classes.

The toughness in the Z direction is improved remarkably by defining the (dA+dB) value to 0.030% or less. It is considered that the A type or B type inclusions have sensitive effect on the toughness in the Z direction as stress concentration sources. It is considered that decrease in the amount of the A type or B type inclusions (dA+dB) decreases the stress concentration sources, and, particularly, reduces the (dA+dB) value to 0.030% to thereby decrease the size of the inclusions, so that the toughness in the Z direction is improved remarkably. Further, the corrosion resistance is also improved by reducing the (dA+dB) value. This is considered that local corrosion resulting from the matrix and the inclusion boundary is suppressed by the decrease in the amount of the impurities.

17) Manufacturing Method

A manufacturing method of steel materials according to the invention is to be explained.

The steel materials according to the invention were prepared by melting with an ordinary known melting method such as a converter method or an electric furnace method and prepared into steel materials by continuous casting method or casting method. Further, in the melting step, a vacuum deggasing refining may be practiced. Then, the steel materials are after being heated in a heating furnace or the like and rolled to a desired shape by hot rolling or directly not by way of heating. Further, the steel materials according to this invention includes, for example, steel plates, steel sheets, bar steels and profiled steels.

EXAMPLE 1

Steels of chemical ingredient shown in Table 1 were melted in a converter furnace and prepared into slabs by a continuous casting process and the slabs were heated and then hot rolled into steel plates of 25 mm thickness×2500 mm width. Tensile property or characteristics and impact shock characteristics of the steel plates were investigated. Further, for the weldability, reproducing heat cycles corresponding to 1 mm weld heat affect zone at input heat of 100 kJ/cm were applied to determine the absorbed energy $_{v}E_{-5}$ at −5° C. of the Charpy impact test.

The result is shown in Table 2. Further, corrosion test specimens of 5 mm×50 mm×100 mm were sampled from the steel plates. The specimens were shot blasted and then served for atmosphere exposure test. In the atmosphere exposure test, a rural district at an atmospheric salt content of 0.02 mg/dm$^2$/day was selected and each of the test specimens was placed being directed to a south direction and at an angle of 30° relative to the ground surface and exposed for one year. Simultaneously, flow rust from the specimens was received in a plastic tank to measure the amount of the flow rust ($Fe^{+2}$). After the exposure test, a rust layer formed on the surface of the matrix was removed and the weight reduction of the test specimens was measured, which was converted into the reduction of plate thickness. The result is shown in Table 2.

Examples of the invention (steel types Nos. 1 to 11) are excellent both in the toughness and the weldability. On the other hand, comparative examples (steel type: Nos. 12–21) and an existent example (steel type: No. 22) have comparable characteristics with those in the examples of this invention excepting that they were degraded in those in which the content for S, Cu and P are out of the upper limit for the range of the invention (steel type: Nos. 13, 17, 18).

The amount of flow rust in the examples of this invention (steel type: Nos. 1–11) is as less as 29 $\mu$g/cm$^3$ to 67 $\mu$g/cm$^3$, which is remarkably lowered compared with 420 $\mu$g/cm$^2$ of the existent example (steel type No. 22) with no addition of B and with lower A value, and the reduction of the plate thickness is 8 $\mu$m to 23 $\mu$m in the example of the invention, which is smaller compared with 38 $\mu$m in the existent example, so that it can be seen that the steel material according to the invention has excellent weathering resistance.

On the other hand, the amount of flow rust in the comparative examples (steel type: Nos. 12–16, 20, 21) out of the range of the invention is increased as 300 $\mu$g/cm$^2$ to 390 $\mu$g/cm$^2$ compared with the examples of this invention. The amount of the flow rust is large in each of cases, that is, in No. 12 since the P content and the A value are excessively low, in No. 13 since the S content is excessively high and the A value is excessively low, in No. 14 since the Cu content and the A value are excessively low, in No. 15 since the B content and the A value are excessively low and in Nos. 20, 21 since the A value is excessively low. Further, the comparative example with excessively high P content (steel type: No. 17) and the comparative example with excessively high Cu content (steel type: No. 18) are comparable with the examples of the invention in view of the weathering resistance (amount of flow rust, reduction of plate thickness) but the toughness and the weldability are degraded. The comparative example of excessively high Ni content (steel type No. 19) is comparable with the examples of this invention in view of the weathering resistance, the toughness and the weldability but the elongation is poor since the strength is excessively high.

EXAMPLE 2

Steels of chemical ingredients shown in Table 3 were melted in a converter furnace and prepared into slabs by the continuous casting process. The slabs were heated and then hot rolled to steel plates of 25 mm thickness×2500 mm width. Further, for a portion for the steels, H-steels of 800×400×16 4 36 size were also manufactured by hot rolling in addition to the steel plates.

For the steel plates and the H steels, tensile characteristics and the impact characteristics were investigated.

Further, the test specimens were sampled at the positions in the L direction and the Z direction at the central portion of the plate thickness (1/2t part) for the steel plates, and in the L direction and the Z direction at the central part of the plate thickness of a flange 1/4 part (1/2t part) for the H steels. The Charpy impact test pieces for the direction of the plate thickness (Z direction) were sampled such that steel plates were pressure welded to the surface and the rear face of steel plates to increase the plate thickness up to 55 mm and the notch part was at 1/2t part. The pressure welding was applied under the condition considering so as not to change the tissue and the nature for the 1/2t part.

Further, for test specimens (in the Z direction) applied with reproducing heat cycles corresponding to 1 mm weld heat affect zone at input heat of 100 kJ/cm, absorbed energy in the Charpy impact test $-_{v}E_{-5}$ was determined to evaluate the weldability.

Further, corrosion test pieces each of 5 mm×50 mm×100 mm were sampled from the steel plates and H steels, shot blasted and served to an atmosphere exposure test to evaluate the weathering resistance. In the atmosphere exposure test, a rural district at an atmospheric salt content of 0.01 mg/dm$^2$/day was selected and each of the test specimens was placed being directed to a south direction and at an angle of 30° relative to the ground surface and exposed for one year. Simultaneously, the amount of the flow rust ($Fe^{2+}$) from the specimens was measured. After the exposure test, a rust layer formed on the surface of the matrix was removed and the weight reduction of the test specimens was measured, which was converted into the reduction of weight thickness.

The test results are shown in Table 4.

Examples of the invention (steel materials Nos. 1 to 17) have high toughness of $_{v}E_{-5}$: 61J or more including also the toughness in the Z direction. Further, the examples of this invention are excellent in the weathering resistance evaluated based on the reduction of the plate thickness and the amount of flow rust. The amount of the flow rust in the examples of this invention (steel material No. 1 to steel material No. 17) is as small as 25 $\mu$g/cm$^2$ to 68 $\mu$g/cm$^2$, which was remarkably decreased compared with 420 $\mu$g/cm$^2$ for the amount of the flow rust in the existent example (steel material No. 26), and it can be seen that the steel materials according to this invention have excellent weathering resistance.

On the other hand, in the comparative examples out of the range of the this invention (steel materials: Nos. 18–26), characteristics in one of the toughness in the Z direction, the HAZ toughness (weldability) and the weathering resistance are low and they are not suitable to structural steel materials.

EXAMPLE 3

Steels of the chemical ingredients shown in Table 5 were melted in a converter furnace and prepared into slabs by the continuous casting process. The slabs were heated and then hot rolled into steel plates each of 25 mm thickness×2500 mm width, and H steels each of 800×400×16×36 size.

For the steel plates and the H steels, the amount of inclusions, tensile characteristics and the impact characteristics were investigated according JIS G 0555. The test specimens were sampled at a position for a central part of the plate thickness (1/2t part) (L direction) in the steel plates and for a flange 1/4B part (1/2t part) (L direction) in the H steels.

Further, Charpy impact test in the direction of the plate thickness (Z direction) was also applied. The Charpy impact test pieces for the direction of the plate thickness (Z direction) were sampled such that steel plates were pressure welded to the surface and the rear face of steel plates to increase the plate thickness up to 55 mm and the notch part was at 1/2t part. The pressure welding was applied under the condition considering so as not to change the tissue and the nature for the 1/2t part.

Further, for the test specimens (Z direction) applied with reproducing heat cycles corresponding to 1 mm weld heat affect zone at input heat of 100 kJ/cm, the absorbed energy $_{v}E_{-5}$ at −5° C. of the Charpy impact test was determined to evaluate weldability.

Further, the amount of inclusions was investigated to determine the (dA+dB) according to JIS G 0555.

Corrosion test pieces each of 5 mm×50 mm×100 mm were sampled from the steel plates and the H steels, shot blasted and then served to an atmospheric exposure test to evaluate the weathering resistance.

In the atmosphere exposure test, a rural district at an atmospheric salt content of 0.8 mg/dm$^2$/day measured by JIS Z 2381 gauze method was selected and each of the test specimens was placed with the matrix surface being directed to a south direction under the condition free from rainfall and exposed for one year. After the end of the exposure test, a rust layer formed by exposure was removed and the reduction of the plate thickness was measured based on the reduction of weight.

The result is shown in Table 6.

The reduction of plate thickness in the examples of the invention is from 6 $\mu$m to 32 $\mu$m, which is remarkably smaller than the reduction of plate thickness (143 $\mu$m) of comparative example (marketed weathering resistant steel, steel material No. 19) showing excellent coast weathering resistance. The toughness in the Z direction in the examples of this invention shows excellent earthquake proofness as $_{v}E_{-5}$ of 59J or more.

Any of the examples of the invention shows excellent earthquake proofness including the weld portion having $_{v}E_{-5}$ at the weld heat affect zone of 169 J or more. Further, the yield ratio was as low as 76% in the examples of this invention, which are excellent in the earthquake proofness.

On the other hand, all of the comparative examples out of the range of the invention show remarkable reduction of plate thickness, lowering of the coast weathering resistance or deterioration of the toughness in the Z reduction.

In the steel No. 11, No. 13, No. 14, No. 15, No. 17, the reduction of plate thickness is larger compared with the reduction of plate thickness and the weathering resistance is degraded.

The reduction of plate thickness of steel No. 12 is comparable with that of the examples of this invention, but the value (dA+dB) for the amount of inclusions is as high as 0.074% and the toughness in the Z direction is as low as $_{v}E_{-5}$: 10J to lower the earthquake proofness Further, the reduction of the plate thickness of the steel No. 16 with high P content is comparable with the examples of this invention and the coast weathering resistance is excellent, but the toughness in the Z direction is as low as $_{v}E_{-5}$: 33J to lower the earthquake proofness and, further the toughness in the HAZ zone is as low as $_{v}E_{-5}$: 31J to lower the weldability.

Further, in the steel No. 18 out of the range of this invention with respect to Ni, the reduction of plate thickness is small but the strength is excessively high as TS: 926 MPa.

EXAMPLE 4

Steels of chemical ingredients show in Table 7 were melted in a converter furnace and prepared in the slabs by the continuous casting process, the slabs were heated and then hot rolled into steel plates of 25 mm thickness×2500 mm width, and into H steels of 800×400×16×36 size.

For the steel plates and the H steels, the amount of inclusions, tensile characteristics and the Charpy impact characteristics were investigated according to JIS G 0555.

The test specimens were sampled at a position for a central part of the plate thickness (1/2t part) (C direction) in the steel plates and for a flange 1/4B part (1/2t part) (L direction) in the H steels.

Further, Charpy impact test in the direction of the plate thickness (Z direction) was also applied. The Charpy impact test pieces for the direction of the plate thickness (Z direction) were sampled such that steel plates were pressure welded to the surface and the rear face of steel plates to increase the plate thickness up to 55 mm and the notch part was at 1/2t part. The pressure welding was applied under the condition considering so as not to change the tissue and the nature for the 1/2t part.

Further, for the test specimens (Z direction) applied with reproducing heat cycles corresponding to 1 mm weld heat affect zone at input heat of 100 kJ/cm, the absorbed energy $_{v}E_{-5}$ at −5° C. of the Charpy impact test was determined to evaluate weldability.

Further, the amount of inclusions was investigated to determine the (dA+dB) according to JIS G 0555.

Further, corrosion test pieces each of 5 mm×50 mm×100 mm were sampled from the steel plates and the H steels, shot blasted and then served to an atmospheric exposure test to evaluate the weathering resistance.

In the atmosphere exposure test, a rural district at an atmospheric salt content of 0.45 mg/dm$^2$/day measured by JIS Z 2381 gauze method was selected and each of the test specimens was placed with the matrix surface being upward horizontally under the condition free from rainfall and exposed for one year. After the end of the exposure test, a rust layer formed by exposure was removed and the reduction of the plate thickness was measured based on the reduction of weight.

The result is shown in Table 8.

The reduction of plate thickness in the examples of this invention is from 14 μm to 40 μm, which is remarkably smaller than the reduction of plate thickness (105 μm) of comparative example (marketed weathering resistant steel, steel material Nos. 2 to 16) showing excellent coast weathering resistance. The toughness in the Z direction in the examples of the invention shows excellent earthquake proofness as $_vE_{-5}$ of 70J or more.

Any of the examples of this invention shows excellent earthquake proofness including the weld portion having $_vE_{-5}$ at the weld heat affect zone of 292 J or more. Further, the yield ration was as low as 80% in the examples of this invention, which are excellent in the earthquake proofness.

On the other hand, all of the comparative examples out of the range of the invention show remarkable reduction of plate thickness, lowering of the coast weathering resistance or deterioration of the toughness in the Z reduction. deteriorates the toughness in the Z direction.

Steel materials Nos. 2–11, Nos. 2–13, Nos. 2–14, Nos. 2–15 of comparative examples show more reduction of plate thickness and deterioration in the weathering resistance compared with examples of the invention since control for the content of alloys is insufficient and the A value is out of range of this invention and the corrosion resistant deterioration due to the atmospheric salt content is predominant.

In steel material Nos. 2–12 of the comparative example, the reduction of plate thickness shows substantially the same value as that of the invented steels but since the amount of inclusions is more and the (dA+dB) value is higher than 0.030%, the toughness in the Z directions is lowered to result in a problem in view of the earthquake proofness.

As described above, the steel material according to this invention is a steel material excellent in weathering resistance for coast districts with high atmospheric salt content (coast weathering resistance) and further excellent in the toughness in the Z direction also including the weld portion and excellent in earthquake proofness, which can be seen suitable as the steel materials for use in steel structures.

INDUSTRIAL APPLICABILITY

According to the invention, weathering resistant steel materials excellent in the earthquake proofness and reduced flow rust can be provided. When the steel materials are used for structural materials such as bridge beams, the coating, surface treatment or the like can be saved to give an expectation for the economical effect of reducing the maintenance cost to provide an outstandingly excellent industrial effect.

Further, steel materials capable of forming stable rust with good protective performance, excellent in the coast weathering resistance and excellent earthquake proofness also including the weld heat affect zone can be manufactured at inexpensively. The steel materials according to the invention can save the painting or surface treatment even in salty circumstances such as coast districts, which can also expect an economical effect of saving the maintenance cost and also can provide a remarkable industrial effect.

TABLE 1

| Type | Chemical composition (wt. %) | | | | | | | | | | | | | | | | |
|---|---|---|---|---|---|---|---|---|---|---|---|---|---|---|---|---|---|
| No. | C | Si | Mn | P | S | Al | Cu | Ni | Cr | B | Mo | Nb | Ti | V | REM | Ca | A value |
| Invented Steel | | | | | | | | | | | | | | | | | |
| 1 | 0.024 | 0.31 | 1.39 | 0.070 | 0.005 | 0.031 | 0.70 | 0.15 | 0.50 | 0.0018 | | | | | | | 19.1 |
| 2 | 0.025 | 0.32 | 1.36 | 0.069 | 0.006 | 0.032 | 0.69 | 0.16 | 0.40 | 0.0023 | 0.2 | | | | | | 21.9 |
| 3 | 0.025 | 0.33 | 1.33 | 0.071 | 0.005 | 0.032 | 0.71 | 0.50 | 0.45 | 0.0023 | | | | 0.1 | | | 25.9 |
| 4 | 0.025 | 0.29 | 1.34 | 0.071 | 0.005 | 0.033 | 0.71 | 0.50 | 0.55 | 0.0027 | | 0.035 | 0.012 | | 0.005 | | 33.1 |
| 5 | 0.014 | 0.30 | 1.06 | 0.055 | 0.004 | 0.028 | 0.56 | 1.01 | 0.60 | 0.0029 | | | | | | | 40.7 |
| 6 | 0.015 | 0.33 | 1.04 | 0.053 | 0.005 | 0.031 | 0.32 | 1.03 | 0.65 | 0.0018 | | | | | | | 24.7 |
| 7 | 0.013 | 0.33 | 1.05 | 0.053 | 0.006 | 0.030 | 0.32 | 1.05 | 0.70 | 0.0018 | | | 0.011 | | | | 25.6 |
| 8 | 0.006 | 0.32 | 0.80 | 0.053 | 0.007 | 0.030 | 0.21 | 2.00 | 0.40 | 0.0017 | | | | | | | 26.6 |
| 9 | 0.007 | 0.35 | 0.82 | 0.025 | 0.005 | 0.029 | 0.20 | 2.01 | 0.50 | 0.0016 | | | | | | | 25.7 |
| 10 | 0.008 | 0.35 | 0.80 | 0.025 | 0.003 | 0.029 | 0.20 | 3.01 | 0.42 | 0.0017 | | 0.034 | | | | | 33.4 |
| 11 | 0.016 | 0.32 | 1.00 | 0.024 | 0.005 | 0.004 | 0.50 | 0.51 | 0.52 | 0.0018 | | | 0.025 | | | 0.002 | 18.2 |
| Comparative Steel | | | | | | | | | | | | | | | | | |
| 12 | 0.016 | 0.31 | 1.03 | 0.004 | 0.006 | 0.029 | 0.32 | 0.40 | 0.50 | 0.0019 | | | | | | | 14.9 |
| 13 | 0.016 | 0.30 | 1.02 | 0.052 | 0.030 | 0.031 | 0.31 | 0.41 | 0.45 | 0.0019 | | | | | | | 16.8 |
| 14 | 0.014 | 0.29 | 1.06 | 0.053 | 0.007 | 0.031 | 0.04 | 0.40 | 0.50 | 0.0018 | | | | | | | 14.7 |
| 15 | 0.027 | 0.30 | 1.40 | 0.071 | 0.006 | 0.034 | 0.72 | 0.01 | 0.02 | 0.0018 | | | | | | | 10.2 |
| 16 | 0.016 | 0.26 | 1.05 | 0.053 | 0.006 | 0.032 | 0.32 | 0.41 | 0.50 | 0.0001 | | | | | | | 7.8 |
| 17 | 0.026 | 0.36 | 1.39 | 0.180 | 0.007 | 0.032 | 0.71 | 0.30 | 0.60 | 0.0025 | | | | | | | 37.2 |
| 18 | 0.025 | 0.34 | 1.32 | 0.070 | 0.006 | 0.029 | 2.20 | 0.30 | 0.70 | 0.0026 | | | | | | | 49.7 |
| 19 | 0.006 | 0.38 | 0.65 | 0.028 | 0.005 | 0.027 | 0.21 | 6.50 | 0.50 | 0.0015 | | | | | | | 57.9 |
| 20 | 0.011 | 0.36 | 1.39 | 0.014 | 0.004 | 0.023 | 0.25 | 0.10 | 0.51 | 0.0009 | 0.2 | | | | | | 8.8 |
| 21 | 0.013 | 0.35 | 1.34 | 0.022 | 0.005 | 0.024 | 0.35 | 0.12 | 0.52 | 0.0008 | 0.1 | | | | | | 9.4 |
| 22 | 0.11 | 0.40 | 1.05 | 0.014 | 0.005 | 0.025 | 0.35 | 0.15 | 0.50 | — | | | | | | | 4.8 |

A value = $(20P + 3Cu + 3Ni + 6Cr + Mo)/(1 - 0.2(10000B)^{0.4})$

TABLE 2

| Type No. | Tensile property: Yield strength (MPa) | Tensile property: Tensile strength (MPa) | Tensile property: Elongation (%) | Toughness vE-5 (J) | Weldability vE-5 (J) | Amount of flow rust($Fe^{+2}$) ($\mu m/cm^2$) | Reduction of plate thickness ($\mu m$) | Remark |
|---|---|---|---|---|---|---|---|---|
| 1 | 456 | 576 | 28 | 376 | 263 | 67 | 23 | Example of Invention |
| 2 | 475 | 595 | 29 | 378 | 266 | 58 | 21 | |
| 3 | 466 | 586 | 29 | 360 | 250 | 48 | 19 | |
| 4 | 490 | 610 | 26 | 359 | 250 | 37 | 8 | |
| 5 | 495 | 615 | 29 | 372 | 286 | 29 | 16 | |
| 6 | 485 | 605 | 30 | 386 | 309 | 51 | 18 | |
| 7 | 466 | 579 | 30 | 385 | 308 | 49 | 8 | |
| 8 | 512 | 640 | 28 | 355 | 295 | 47 | 14 | |
| 9 | 511 | 645 | 31 | 382 | 336 | 48 | 14 | |
| 10 | 561 | 655 | 31 | 333 | 298 | 36 | 10 | |
| 11 | 460 | 585 | 29 | 380 | 273 | 66 | 22 | |
| 12 | 430 | 494 | 33 | 390 | 388 | 348 | 32 | Comparative Example |
| 13 | 433 | 532 | 30 | 80 | 32 | 350 | 29 | |
| 14 | 411 | 503 | 34 | 380 | 355 | 300 | 39 | |
| 15 | 431 | 550 | 34 | 375 | 265 | 345 | 31 | |
| 16 | 434 | 535 | 32 | 380 | 332 | 380 | 28 | |
| 17 | 468 | 647 | 27 | 42 | 35 | 58 | 17 | |
| 18 | 496 | 632 | 28 | 85 | 75 | 70 | 15 | |
| 19 | 725 | 925 | 23 | 340 | 315 | 34 | 5 | |
| 20 | 414 | 477 | 35 | 357 | 320 | 380 | 38 | |
| 21 | 423 | 496 | 35 | 346 | 330 | 390 | 34 | |
| 22 | 365 | 505 | 36 | 380 | 50 | 420 | 38 | Existent example |

TABLE 3

| Steel No. | Chemical composition (wt. %): C | Si | Mn | P | S | Al | Cu | Ni | Cr | B | Others | A value |
|---|---|---|---|---|---|---|---|---|---|---|---|---|
| A | 0.022 | 0.30 | 1.35 | 0.065 | 0.0026 | 0.031 | 0.70 | 0.15 | 0.50 | 0.0018 | | 18.8 |
| B | 0.020 | 0.24 | 1.22 | 0.063 | 0.0022 | 0.030 | 0.65 | 0.16 | 0.52 | 0.0020 | Mo:0.14 | 20.6 |
| C | 0.020 | 0.15 | 1.30 | 0.061 | 0.0021 | 0.020 | 0.32 | 0.43 | 0.55 | 0.0020 | V:0.05 | 20.1 |
| D | 0.015 | 0.27 | 1.35 | 0.067 | 0.0030 | 0.001 | 0.22 | 0.63 | 0.55 | 0.0018 | Nb:0.29,Ti:0.012,REM:0.005 | 19.7 |
| E | 0.018 | 0.30 | 1.06 | 0.049 | 0.0015 | 0.027 | — | 1.01 | 0.55 | 0.0030 | | 33.2 |
| F | 0.009 | 0.43 | 1.09 | 0.063 | 0.0028 | 0.034 | — | 1.03 | 0.65 | 0.0018 | | 22.6 |
| G | 0.013 | 0.33 | 1.05 | 0.032 | 0.0008 | 0.001 | — | 1.05 | 0.70 | 0.0018 | Ti:0.011 | 21.9 |
| H | 0.006 | 0.32 | 0.80 | 0.010 | 0.0018 | 0.030 | — | 2.00 | 0.41 | 0.0020 | | 25.7 |
| I | 0.007 | 0.35 | 0.82 | 0.026 | 0.0029 | 0.029 | — | 2.01 | 0.50 | 0.0016 | | 24.3 |
| J | 0.019 | 0.35 | 0.83 | 0.010 | 0.0009 | 0.029 | — | 3.01 | 0.42 | 0.0017 | Nb:0.034 | 31.0 |
| K | 0.016 | 0.32 | 1.00 | 0.024 | 0.0022 | 0.004 | 0.50 | 1.01 | 0.52 | 0.0018 | Ti:0.025,Ca0.002 | 22.3 |
| L | 0.018 | 0.25 | 0.87 | 0.015 | 0.0005 | 0.002 | 0.53 | 0.31 | 0.87 | 0.0018 | Nb:0.041,Ti:0.007 | 22.1 |
| M | 0.028 | 0.12 | 1.22 | 0.023 | 0.0007 | 0.005 | 0.67 | 0.64 | 0.62 | 0.0012 | Mo:0.15,Nb:0.035,Ti:0.010 | 18.0 |
| N | 0.021 | 0.31 | 1.51 | 0.032 | 0.0007 | 0.005 | 0.52 | 0.37 | 0.36 | 0.0033 | Nb:0.042 | 28.8 |
| O | 0.016 | 0.31 | 1.03 | 0.005 | 0.0028 | 0.029 | 0.70 | 0.15 | 0.50 | 0.0019 | | 16.1 |
| P | 0.016 | 0.30 | 1.02 | 0.063 | 0.0025 | 0.031 | 0.35 | 0.25 | 0.46 | 0.0019 | | 16.6 |
| Q | 0.014 | 0.29 | 1.06 | 0.009 | 0.0030 | 0.031 | — | — | 0.01 | 0.0018 | | 0.7 |
| R | 0.025 | 0.28 | 1.35 | 0.064 | 0.0080 | 0.029 | 0.50 | 0.45 | 0.45 | 0.0020 | | 20.3 |
| S | 0.052 | 0.26 | 1.05 | 0.020 | 0.0025 | 0.032 | 0.63 | 0.26 | 0.50 | 0.0024 | | 21.2 |
| T | 0.026 | 0.36 | 1.39 | 0.220 | 0.0018 | 0.032 | — | — | 0.60 | 0.0025 | | 29.1 |
| U | 0.011 | 0.36 | 1.39 | 0.070 | 0.0028 | 0.023 | 0.70 | 0.10 | 0.51 | 0.0009 | Mo:0.20 | 13.6 |
| V | 0.013 | 0.35 | 1.34 | 0.068 | 0.0030 | 0.024 | — | 6.37 | 0.52 | 0.0008 | | 43.6 |
| W | 0.110 | 0.40 | 1.05 | 0.014 | 0.0050 | 0.025 | 0.35 | 0.15 | 0.50 | — | | 4.8 |

A value = $(20P + 3Cu + 3Ni + 6Cr + Mo)/(1 - 0.2(10000B)^{0.4})$

TABLE 4

| Material No. | Steel Type | Steel No. | Amount of inclusion: dA + dB (wt. %) | dC (wt. %) | (dA + dB + dC) (wt. %) | Weathering resistance: Amount of flow rust (Fe2+) ($\mu g/cm^2$) | Reduction of plate thickness ($\mu m$) | Tensile property: Yield strength YS (MPa) | Tensile strength TS (MPa) | Toughness vE-5: L direction (J) | Z direction (J) | Weldability vE-5 HAZ (J) | Remark |
|---|---|---|---|---|---|---|---|---|---|---|---|---|---|
| 1 | Plate | A | 0.029 | 0.000 | 0.029 | 68 | 23 | 455 | 571 | 383 | 73 | 235 | Example of Invention |
| 2 | H steel | | 0.027 | 0.000 | 0.027 | 66 | 22 | 432 | 566 | 292 | 66 | — | |
| 3 | Plate | B | 0.026 | 0.000 | 0.026 | 62 | 21 | 450 | 564 | 394 | 91 | 245 | |
| 4 | | C | 0.023 | 0.000 | 0.023 | 64 | 26 | 438 | 546 | 395 | 105 | 253 | |
| 5 | H steel | | 0.025 | 0.000 | 0.025 | 64 | 27 | 411 | 563 | 341 | 80 | — | |

TABLE 4-continued

| Steel | | | Amount of inclusion | | | Weathering resistance | | Tensile property | | Toughness vE-5 | | Weldability vE-5 | |
|---|---|---|---|---|---|---|---|---|---|---|---|---|---|
| Material No. | Type | Steel No. | dA + dB (wt. %) | dC (wt. %) | (dA + dB + dC) (wt. %) | Amount of flow rust (Fe2+) ($\mu$g/cm$^2$) | Reduction of plate thickness ($\mu$m) | Yield strength YS (MPa) | Tensile strength TS (MPa) | L direction (J) | Z direction (J) | HAZ (J) | Remark |
| 6 | Plate | D | 0.025 | 0.043 | 0.068 | 65 | 11 | 441 | 554 | 381 | 92 | 245 | |
| 7 | | E | 0.015 | 0.000 | 0.015 | 37 | 25 | 438 | 539 | 406 | 124 | 277 | |
| 8 | | F | 0.028 | 0.000 | 0.028 | 56 | 22 | 440 | 552 | 389 | 83 | 261 | |
| 9 | | G | 0.007 | 0.012 | 0.019 | 58 | 11 | 439 | 528 | 421 | 146 | 292 | |
| 10 | H steel | | 0.009 | 0.016 | 0.025 | 60 | 13 | 408 | 528 | 399 | 138 | — | |
| 11 | Plate | H | 0.023 | 0.000 | 0.023 | 48 | 16 | 483 | 574 | 408 | 88 | 300 | |
| 12 | | I | 0.027 | 0.000 | 0.027 | 52 | 15 | 485 | 588 | 391 | 61 | 284 | |
| 13 | | J | 0.010 | 0.012 | 0.022 | 39 | 11 | 534 | 645 | 356 | 68 | 273 | |
| 14 | | K | 0.019 | 0.021 | 0.040 | 57 | 5 | 477 | 573 | 409 | 90 | 278 | |
| 15 | | L | 0.005 | 0.003 | 0.008 | 30 | 13 | 442 | 519 | 406 | 153 | 308 | |
| 16 | | M | 0.005 | 0.007 | 0.012 | 32 | 9 | 474 | 568 | 359 | 200 | 270 | |
| 17 | | N | 0.007 | 0.000 | 0.007 | 25 | 27 | 452 | 542 | 383 | 108 | 263 | |
| 18 | | O | 0.028 | 0.000 | 0.028 | 81 | 26 | 449 | 520 | 400 | 86 | 306 | Comparative example |
| 19 | | P | 0.029 | 0.000 | 0.029 | 78 | 30 | 429 | 535 | 414 | 87 | 267 | |
| 20 | | Q | 0.028 | 0.000 | 0.028 | 200 | 717 | 387 | 437 | 428 | 92 | 339 | |
| 21 | | R | 0.048 | 0.000 | 0.048 | 63 | 23 | 454 | 570 | 379 | 18 | 238 | |
| 22 | | S | 0.029 | 0.000 | 0.029 | 65 | 26 | 449 | 516 | 406 | 36 | 110 | |
| 23 | | T | 0.023 | 0.000 | 0.023 | 42 | 31 | 400 | 608 | 269 | 21 | 33 | |
| 24 | | U | 0.029 | 0.000 | 0.029 | 97 | 21 | 453 | 572 | 379 | 78 | 230 | |
| 25 | | V | 0.031 | 0.000 | 0.031 | 27 | 5 | 710 | 932 | 105 | 20 | 111 | |
| 26 | | W | 0.048 | 0.000 | 0.048 | 420 | 38 | 365 | 505 | 380 | 20 | 50 | Existent example |

TABLE 5

| Steel material | | Chemical composition (wt. %) | | | | | | | | | | | |
|---|---|---|---|---|---|---|---|---|---|---|---|---|---|
| No. | Type | C | Si | Mn | P | S | Al | Cu | Ni | B | Others | A value* | B value** |
| 1 | Plate | 0.021 | 0.28 | 1.25 | 0.087 | 0.0025 | 0.028 | 1.15 | 1.48 | 0.0021 | | 14.3 | 11.4 |
| 2 | H steel | 0.008 | 0.38 | 1.08 | 0.057 | 0.0015 | 0.031 | 1.38 | 1.38 | 0.0020 | Mo0.18 | 15.2 | 11.4 |
| 3 | Plate | 0.017 | 0.30 | 1.43 | 0.110 | 0.0008 | 0.027 | 1.01 | 1.32 | 0.0018 | V:0.051 | 12.9 | 11.4 |
| 4 | | 0.023 | 0.25 | 1.31 | 0.122 | 0.0014 | 0.001 | 1.05 | 1.23 | 0.0021 | Nb:0.035,Ti:0.001, REM:0.004 | 13.2 | 11.4 |
| 5 | H steel | 0.020 | 0.31 | 1.00 | 0.064 | 0.0022 | 0.025 | 0.78 | 2.25 | 0.0018 | | 14.9 | 11.4 |
| 6 | Plate | 0.015 | 0.22 | 1.32 | 0.070 | 0.0026 | 0.030 | 0.58 | 2.13 | 0.0021 | | 13.7 | 11.4 |
| 7 | H steel | 0.017 | 0.34 | 1.10 | 0.078 | 0.0007 | 0.001 | 0.57 | 2.02 | 0.0017 | Ti:0.012 | 12.9 | 11.4 |
| 8 | Plate | 0.012 | 0.46 | 1.00 | 0.052 | 0.0022 | 0.033 | 0.30 | 3.00 | 0.0022 | | 15.7 | 11.4 |
| 9 | | 0.005 | 0.32 | 1.03 | 0.033 | 0.0007 | 0.026 | 0.35 | 2.87 | 0.0020 | | 14.9 | 11.4 |
| 10 | H steel | 0.020 | 0.20 | 1.04 | 0.035 | 0.0026 | 0.030 | 0.30 | 3.00 | 0.0020 | Nb:0.045 | 15.2 | 11.4 |
| 11 | Plate | 0.015 | 0.28 | 1.28 | 0.090 | 0.0025 | 0.028 | 0.01 | 2.00 | 0.0018 | | 10.0 | 11.4 |
| 12 | | 0.020 | 0.31 | 1.06 | 0.083 | 0.0080 | 0.030 | 0.44 | 2.03 | 0.0018 | | 12.4 | 11.4 |
| 13 | | 0.020 | 0.33 | 1.21 | 0.087 | 0.0025 | 0.031 | 0.03 | 2.00 | 0.0020 | | 10.2 | 11.4 |
| 14 | | 0.035 | 0.31 | 1.38 | 0.098 | 0.0024 | 0.028 | 1.15 | 1.38 | 0.0019 | | 13.8 | 11.4 |
| 15 | | 0.015 | 0.25 | 0.78 | 0.076 | 0.0024 | 0.027 | 0.50 | 0.51 | 0.0020 | | 6.2 | 11.4 |
| 16 | | 0.025 | 0.35 | 1.38 | 0.205 | 0.0025 | 0.030 | 1.02 | 1.50 | 0.0024 | | 15.8 | 11.4 |
| 17 | | 0.024 | 0.33 | 1.31 | 0.100 | 0.0022 | 0.031 | 1.60 | 1.50 | 0.0001 | | 13.5 | 11.4 |
| 18 | | 0.007 | 0.37 | 0.63 | 0.040 | 0.0007 | 0.025 | 0.30 | 6.95 | 0.0015 | | 31.2 | 11.4 |
| 19 | | 0.110 | 0.40 | 1.05 | 0.014 | 0.0050 | 0.025 | 0.35 | 0.15 | — | Cr:0.50 | 2.0 | 11.4 |

*A value = $(11P + 4.0Cu + 3.1Ni + 2.6Mo)/(1 - 0.1(10000B)^{0.35})$

**B value = 1 + 13X X: Atmospheric salt contents = 0.8 mg/dm$^2$/day

TABLE 6

| Steel Material | | Amount of inclusion (wt. %) | | | Weathering resistance Reduction of plate thickness | Tensile property Yield strength YS | Tensile strength TS | Yield ratio YR | Toughness L direction vE-5 | Toughness Z direction vE-5 | Weldability HAZ vE-5* | |
|---|---|---|---|---|---|---|---|---|---|---|---|---|
| No. | Type | dA + dB | dC | dA + dB + dC | (μm) | (MPa) | (MPa) | (%) | (J) | (J) | (J) | Remark |
| 1 | Plate | 0.028 | 0.000 | 0.028 | 19 | 488 | 681 | 72 | 277 | 60 | 208 | Example of invention |
| 2 | H steel | 0.020 | 0.000 | 0.020 | 10 | 498 | 673 | 74 | 309 | 91 | 250 | |
| 3 | Plate | 0.013 | 0.000 | 0.013 | 32 | 471 | 674 | 70 | 260 | 116 | 178 | |
| 4 | | 0.012 | 0.035 | 0.047 | 29 | 470 | 681 | 69 | 257 | 129 | 169 | |
| 5 | H steel | 0.025 | 0.000 | 0.025 | 14 | 493 | 673 | 73 | 293 | 71 | 259 | |
| 6 | Plate | 0.029 | 0.000 | 0.029 | 25 | 474 | 651 | 73 | 287 | 59 | 248 | |
| 7 | H steel | 0.006 | 0.014 | 0.020 | 32 | 466 | 646 | 72 | 296 | 135 | 257 | |
| 8 | Plate | 0.027 | 0.000 | 0.027 | 6 | 491 | 663 | 74 | 291 | 65 | 285 | |
| 9 | | 0.012 | 0.000 | 0.012 | 13 | 488 | 645 | 76 | 313 | 126 | 313 | |
| 10 | H steel | 0.029 | 0.015 | 0.044 | 11 | 491 | 650 | 76 | 306 | 63 | 308 | |
| 11 | Plate | 0.028 | 0.000 | 0.028 | 58 | 423 | 594 | 71 | 304 | 65 | 272 | Comparative example |
| 12 | | 0.074 | 0.000 | 0.074 | 36 | 456 | 636 | 72 | 299 | 10 | 262 | |
| 13 | | 0.029 | 0.000 | 0.029 | 56 | 424 | 593 | 71 | 309 | 65 | 279 | |
| 14 | | 0.027 | 0.000 | 0.027 | 42 | 485 | 684 | 71 | 265 | 59 | 186 | |
| 15 | | 0.027 | 0.000 | 0.027 | 92 | 382 | 528 | 72 | 393 | 88 | 348 | |
| 16 | | 0.028 | 0.000 | 0.028 | 6 | 485 | 763 | 64 | 158 | 33 | 31 | |
| 17 | | 0.026 | 0.000 | 0.026 | 43 | 526 | 743 | 71 | 238 | 54 | 147 | |
| 18 | | 0.012 | 0.000 | 0.012 | 16 | 684 | 926 | 74 | 126 | 49 | 173 | |
| 19 | | 0.048 | 0.000 | 0.048 | 143 | 365 | 505 | 72 | 380 | 20 | 50 | |

*Z direction

TABLE 7

| Steel material | | Chemical composition (wt. %) | | | | | | | | | | A | B |
|---|---|---|---|---|---|---|---|---|---|---|---|---|---|
| No. | Type | C | Si | Mn | P | S | Al | Cu | Ni | B | Others | value* | value** |
| 2-1 | Plate | 0.022 | 0.31 | 1.37 | 0.073 | 0.0023 | 0.030 | 0.63 | 0.70 | 0.0018 | | 7.6 | 6.9 |
| 2-2 | H steel | 0.017 | 0.30 | 1.40 | 0.075 | 0.0030 | 0.030 | 0.58 | 0.71 | 0.0015 | Mo:0.22 | 8.0 | 6.9 |
| 2-3 | Plate | 0.027 | 0.27 | 1.40 | 0.070 | 0.0025 | 0.031 | 0.60 | 0.70 | 0.0020 | V:0.032 | 7.5 | 6.9 |
| 2-4 | | 0.020 | 0.30 | 1.40 | 0.071 | 0.0006 | 0.006 | 0.55 | 0.73 | 0.0021 | Nb:0.031,Ti:0.016,REM:0.0042 | 7.4 | 6.9 |
| 2-5 | H steel | 0.017 | 0.30 | 1.36 | 0.055 | 0.0015 | 0.029 | 0.62 | 1.14 | 0.0016 | | 9.0 | 6.9 |
| 2-6 | Plate | 0.020 | 0.30 | 1.33 | 0.051 | 0.0020 | 0.032 | 0.45 | 1.03 | 0.0020 | | 7.8 | 6.9 |
| 2-7 | H steel | 0.011 | 0.23 | 1.27 | 0.054 | 0.0005 | 0.001 | 0.43 | 1.10 | 0.0014 | Ti:0.020 | 7.7 | 6.9 |
| 2-8 | Plate | 0.020 | 0.25 | 1.00 | 0.050 | 0.0030 | 0.035 | 0.20 | 1.92 | 0.0011 | | 9.5 | 6.9 |
| 2-9 | | 0.022 | 0.31 | 0.98 | 0.036 | 0.0025 | 0.030 | 0.20 | 2.01 | 0.0007 | | 9.3 | 6.9 |
| 2-10 | | 0.026 | 0.28 | 1.02 | 0.016 | 0.0090 | 0.002 | 0.80 | 1.53 | 0.0014 | Ti:0.014 | 10.9 | 6.9 |
| 2-11 | | 0.015 | 0.25 | 1.48 | 0.015 | 0.0028 | 0.025 | 0.41 | 0.98 | 0.0020 | | 6.8 | 6.9 |
| 2-12 | | 0.021 | 0.30 | 1.35 | 0.048 | 0.0070 | 0.033 | 0.51 | 1.00 | 0.0018 | | 7.8 | 6.9 |
| 2-13 | | 0.015 | 0.15 | 1.42 | 0.055 | 0.0027 | 0.030 | 0.02 | 1.05 | 0.0020 | | 5.5 | 6.9 |
| 2-14 | | 0.018 | 0.33 | 1.38 | 0.051 | 0.0022 | 0.033 | 0.45 | 0.02 | 0.0015 | | 3.3 | 6.9 |
| 2-15 | | 0.015 | 0.31 | 1.40 | 0.055 | 0.0025 | 0.025 | 0.42 | 1.08 | 0.0001 | | 6.3 | 6.9 |
| 2-16 | | 0.110 | 0.40 | 1.05 | 0.014 | 0.0050 | 0.025 | 0.35 | 0.15 | — | Cr:0.05 | 2.0 | 6.9 |

TABLE 8

| Steel Material | | Amount of inclusion (%) | | | Weathering resistance Reduction of plate thickness | Tensile property Yield strength YS | Tensile strength TS | Yield ratio YR | Toughness L direction vE-5 | Toughness Z direction vE-5 | Weldability HAZ vE-5* | |
|---|---|---|---|---|---|---|---|---|---|---|---|---|
| No. | Type | dA + dB | dC | dA + dB + dC | (μm) | (MPa) | (MPa) | (%) | (J) | (J) | (J) | Remark |
| 2-1 | Plate | 0.027 | 0.000 | 0.027 | 38 | 456 | 608 | 75 | 350 | 80 | 293 | Example of Invention |
| 2-2 | H steel | 0.030 | 0.000 | 0.030 | 31 | 456 | 607 | 75 | 350 | 70 | 293 | |
| 2-3 | Plate | 0.029 | 0.000 | 0.029 | 38 | 455 | 607 | 75 | 349 | 72 | 292 | |
| 2-4 | | 0.007 | 0.049 | 0.056 | 37 | 457 | 608 | 75 | 253 | 162 | 293 | |
| 2-5 | H steel | 0.020 | 0.000 | 0.020 | 28 | 477 | 620 | 77 | 351 | 116 | 310 | |
| 2-6 | Plate | 0.025 | 0.000 | 0.025 | 40 | 459 | 594 | 77 | 365 | 96 | 331 | |
| 2-7 | H steel | 0.004 | 0.015 | 0.019 | 40 | 458 | 593 | 77 | 347 | 150 | 332 | |
| 2-8 | Plate | 0.030 | 0.000 | 0.030 | 26 | 474 | 619 | 77 | 353 | 71 | 339 | |
| 2-9 | | 0.028 | 0.000 | 0.028 | 26 | 478 | 612 | 78 | 366 | 80 | 362 | |
| 2-10 | | 0.008 | 0.008 | 0.016 | 14 | 506 | 637 | 80 | 375 | 281 | 356 | |

TABLE 8-continued

| Steel Material | | Amount of inclusion (%) | | | Weathering resistance Reduction of plate thickness | Tensile property Yield strength YS | Tensile strength TS | Yield ratio YR | Toughness L direction vE-5 | Z direction vE-5 | Weldability HAZ vE-5* | |
|---|---|---|---|---|---|---|---|---|---|---|---|---|
| No. | Type | dA + dB | dC | dA + dB + dC | (μm) | (MPa) | (MPa) | (%) | (J) | (J) | (J) | Remark |
| 2-11 | | 0.030 | 0.000 | 0.030 | 47 | 454 | 562 | 81 | 403 | 82 | 386 | Comparative example |
| 2-12 | | 0.067 | 0.000 | 0.067 | 32 | 467 | 607 | 77 | 358 | 33 | 123 | |
| 2-13 | | 0.030 | 0.000 | 0.030 | 56 | 429 | 554 | 77 | 381 | 82 | 357 | |
| 2-14 | | 0.027 | 0.000 | 0.027 | 77 | 407 | 522 | 78 | 414 | 90 | 368 | |
| 2-15 | | 0.027 | 0.000 | 0.027 | 51 | 458 | 595 | 77 | 363 | 80 | 328 | |
| 2-16 | | 0.048 | 0.000 | 0.048 | 105 | 365 | 505 | 72 | 380 | 20 | 50 | |

*Z direction

What is claimed:

1. A method for manufacturing a weathering resistant steel material comprising the steps of:

preparing a slab by continuous casting a molten steel, having a composition containing, on a weight % basis, C: from 0.001% to 0.050%;

Si: 0.60% or less;

Mn: from 0.50% to 3.00%;

S: 0.0029% or less;

Al: 0.05% or less;

B: from 0.0003% to 0.0050%;

at least one element selected from the group consisting of P: from 0.005% to 0.15%, Cu: from 0.1% to 2.0%, Ni: from 0.1% to 6.0%, Cr: from 0.005% to 1.0% and Mo: from 0.005% to 1.0%, and satisfying the following equation (1)

$$(20P+3Cu+3Ni+6Cr+Mo)/(1-0.2(10000B)^{0.4} \geqq 18 \quad (1)$$

in which P, Cu, Ni, Cr, Mo, B: content for each element in weight %, and the balance being Fe and inevitable impurities, wherein the total sum (dA+dB) value for the amount of A type inclusions and the amount of B type inclusions according to JIS C 0555 is 0.030% or less, and reheating and hot rolling the slab to obtain a weathering resistant steel having a toughness in the Z direction of 47 J or more at −5° C. in the Charpy impact test.

2. The method as defined in claim 1, wherein the molten steel contains at least one element selected from the group consisting of Nb: 0.005% to 0.20%; Ti: 0.005% to 0.20%; and V: 0.005% to 0.20%.

3. The method as defined in claim 1, wherein the molten steel contains at least one of Ca: 0.02% or less and REM: 0.02% or less.

4. The method as defined in claim 1, wherein the steel material comprises a thick steel plate.

5. The method as defined in claim 1, wherein the steel material comprises an H steel.

6. A method for manufacturing a weathering resistant steel material comprising the steps of:

preparing a slab by continuous casting a molten steel, having a composition containing, on a weight % basis, C: from 0.001% to 0.050%;

Si: 0.60% or less;

Mn: from 0.50% to 3.00%;

S: 0.0029% or less;

Al: 0.10% or less;

B: from 0.0003% to 0.0050%;

at least one element selected from the group consisting of P: from 0.005% to 0.15%, Cu: from 0.1% to 2.0%, Ni: from 0.1% to 6.0%, Cr: from 0.005% to 1.0% and Mo: from 0.005% to 1.0%, and satisfying the following equation (1)

$$(11P+4.0Cu+3.1Ni+2.6Mo)/(1-0.1(1000B)^{0.35}) \geqq 1+13X \quad (1)$$

in which P, Cu, Ni, Mo, B: content for each element in weight %, and X: atmospheric salt content in $mg/dm^2/day$, and the balance being Fe and inevitable impurities, wherein the total sum (dA+dB) value for the amount of A type inclusions and the amount of B type inclusions according to JIS G 0555 is 0.030% or less, and reheating and hot rolling the slab to obtain a weathering resistant steel material having a toughness in the Z direction of 47 J or more at −5° C. in the Charpy impact test.

7. The method as defined in claim 6, wherein the molten steel further contains at least one of Ca: 0.02% or less and REM: 0.02% or less.

8. The method as defined in claim 6, wherein the steel material comprises a thick steel plate.

9. The method as defined in claim 6, wherein the steel material comprises an H steel.

* * * * *